United States Patent [19]

Aoyagi et al.

[11] Patent Number: 4,768,339

[45] Date of Patent: Sep. 6, 1988

[54] HYDRAULIC DRIVE SYSTEM

[75] Inventors: Yukio Aoyagi; Shuichi Ichiyama; Keiichiro Uno; Tomohiko Yasuda, all of Tsuchiura, Japan

[73] Assignee: Hitachi Construction Machinery Co., Ltd., Tokyo, Japan

[21] Appl. No.: 6,381

[22] Filed: Jan. 26, 1987

[30] Foreign Application Priority Data

Jan. 25, 1986 [JP] Japan ..... 61-12987
Apr. 4, 1986 [JP] Japan ..... 61-76797

[51] Int. Cl.[4] ..... F15B 13/08

[52] U.S. Cl. ..... 60/427; 60/428; 91/6; 91/513

[58] Field of Search ..... 60/427, 428; 91/6, 513

[56] References Cited

U.S. PATENT DOCUMENTS 4,561,824 12/1985 Okabe et al. .
4,586,330 5/1986 Watanabe et al. ..... 60/428 X

FOREIGN PATENT DOCUMENTS 59471 9/1982 European Pat. Off. .
87748 9/1983 European Pat. Off. .
2101492 7/1972 Fed. Rep. of Germany .
2631530 1/1978 Fed. Rep. of Germany .
8102914 10/1981 PCT Int'l Appl. .

*Primary Examiner*—Gerald A. Michalsky
*Attorney, Agent, or Firm*—Antonelli, Terry & Wands

[57] ABSTRACT

A hydraulic drive system for a construction machine in which a hydraulic circuit has at least one hydraulic pump, at least first and second hydraulic actuators driven by a hydraulic fluid discharged from the pump, and at least first and second directional control valves connected to the pump in parallel with each other for controlling flows of hydraulic fluid supplied from the pump to the first and second actuators, respectively, and a control unit is responsive to first and second operation signals for driving the first and second actuators, respectively, to produce first and second control signals for actuating the first and second valves and deliver such control signals thereto, respectively, each of the first and second valves having a degree of opening changed in accordance with a level of the corresponding one of the first and second control signals for controlling a flow rate of hydraulic fluid supplied to the corresponding one of the first and second actuators. The control unit includes restriction means for restricting the level of the first control signal for restriction of the degree of opening of the first directional control valve when both of the first and second operation signals are entered in the control unit for instruction to perform simultaneous driving of the first and second hydraulic actuators.

18 Claims, 14 Drawing Sheets

HYDRAULIC DRIVE SYSTEM

BACKGROUND OF THE INVENTION

The present invention relates to hydraulic drive systems, and in particular to a hydraulic drive system for a construction machine, such as a hydraulic excavator and hydraulic crane, having a plurality of working elements, which enables a variety of combined operation of there working elements to be performed with less number of hydraulic pumps.

The hydraulic drive system of such type is known from JP-A-58-146632, for example, which corresponds to U.S. Pat. No. 4,561,824 and EP-A-059471. This known hydraulic drive system comprises two hydraulic circuits each having a valve group including a hydraulic pump, travel directional control valve, swing directional control valve, boom directional control valve, arm directional control valve, and bucket directional control valve, which are connected to the respective hydraulic actuators such as travel motor, swing motor, boom cylinder, arm cylinder and bucket cylinder. Such connection of a plurality of valves to each of the boom cylinder, arm cylinder, bucket cylinder, etc., enables simultaneous driving of the travel motors and the other actuators to be performed substantially independently of each other for combined operation of the travel devices and the other working elements and also simultaneous driving of those other actuators to be performed substantially independently of each other for combined operation of the other working elements, as well as a single driving of each of the other actuators to be performed with two pumps for high speed operation of the associated working element.

However, the hydraulic drive system with such structure has a drawback that the manufacture cost is relatively expensive since the number of directional control valves connected to the actuators such as boom cylinder, arm cylinder, bucket cylinder, etc., must be increased

SUMMARY OF THE INVENTION

In view of the circumstances of the prior art, an object of the present invention is to provide a hydraulic drive system which can perform independent simultaneous driving of a plurality of hydraulic actuators for combined operation of the associated working elements with less number of directional control valves.

According to the present invention, there is provided a hydraulic drive system for a construction machine comprising: hydraulic circuit means including at least one hydraulic pump, at least first and second hydraulic actuators driven by a hydraulic fluid discharged from said pump, and at least first and second directional control valves connected to said pump in parallel with each other for controlling flows of hydraulic fluid supplied from the pump to said first and second actuators, respectively; and control means responsive to first and second operation signals for driving said first and second actuators, respectively, to produce first and second control signals for actuating said first and second valves and deliver such control signals thereto, respectively, each of the first and second valves having a degree of opening changed in accordance with a level of the corresponding one of said first and second control signals for controlling a flow rate of hydraulic fluid supplied to the corresponding one of the first and second actuators: said control means including restriction means for restricting the level of said first control signal delivered from the control means for restriction of the degree of opening of said first directional control valve when both of said first and second operation signals are entered in the control means for instruction to perform simultaneous driving of said first and second hydraulic actuators.

With the above-mentioned structure of the present invention, when the first and second hydraulic actuators are to be driven simultaneously, the restriction of the degree of opening of the directional control valve for the first actuator performed by the restriction means of the control means ensures independent simultaneous driving thereof with the arrangement of one directional control valve for one hydraulic actuator.

DESCRIPTION OF THE PREFERRED EMBODIMENTS

Figure 1A:
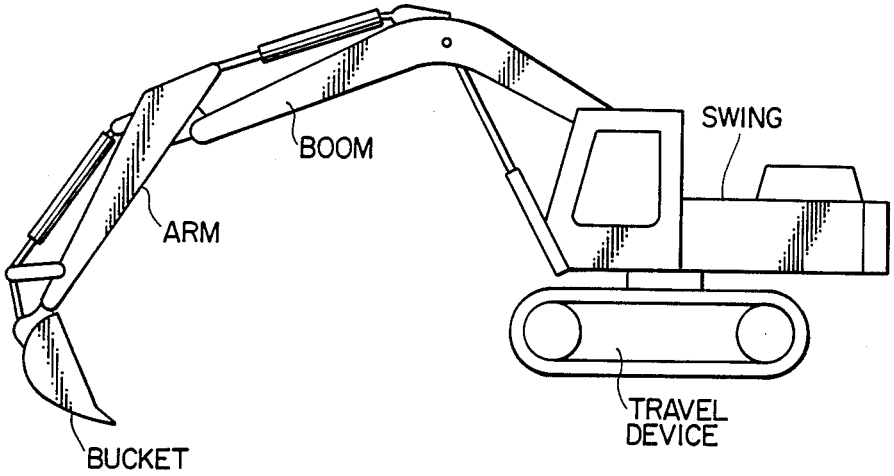
FIG. 1A (PRIOR ART)
FIG. 1A is a side elevation of a conventional construction machine to which the present invention may be applied.

FIG. 1A shows a conventional construction machine having a bucket, arm, boom, swing and a pair of travel devices (only one shown) to which the present invention may be applied.

Figure 1B:
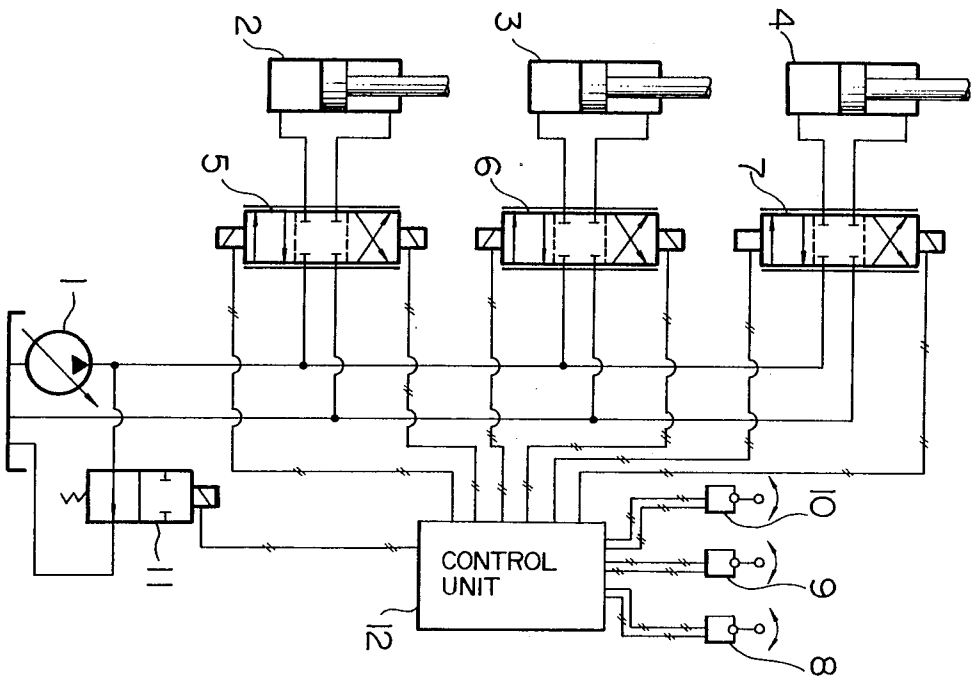
FIG. 1B is a circuit diagram showing a hydraulic drive system for a construction machine in one preferred embodiment according to the present invention.

Referring to FIG. 1B, reference numeral 1 designates a hydraulic pump and reference numerals 2, 3 and 4 indicate first, second and third hydraulic actuators, respectively. Directional control valves 5, 6 and 7 are connected to the pump 1 through a hydraulic fluid supply line 1*a* for controlling flows of hydraulic fluid supplied from the pump 1 to the actuators 2, 3 and 4, respectively. Each of the valves 5, 6 and 7 preferably comprises the solenoid operated valve actuated by an electric signal, for example, and may be a three position four way valve of the center block type with two of four ports connected to the pump 1 and a reservoir, respectively and the other two connected to the associated one of the actuators 2, 3 and 4. Corresponding operation devices 8, 9 and 10 are provided which preferably comprise potentiometers and provide operations signals for driving of the actuators 2, 3 and 4, respectively. The hydraulic fluid supply line 1*a* is connected to the reservoir through a bypass line in which is connected a bypass valve 11 actuated by an electric signal.

The above-mentioned directional control valves 5, 6 and 7, operation devices 8, 9 and 10 and bypass valve 11 are all connected to a control unit 12.

Figure 2:
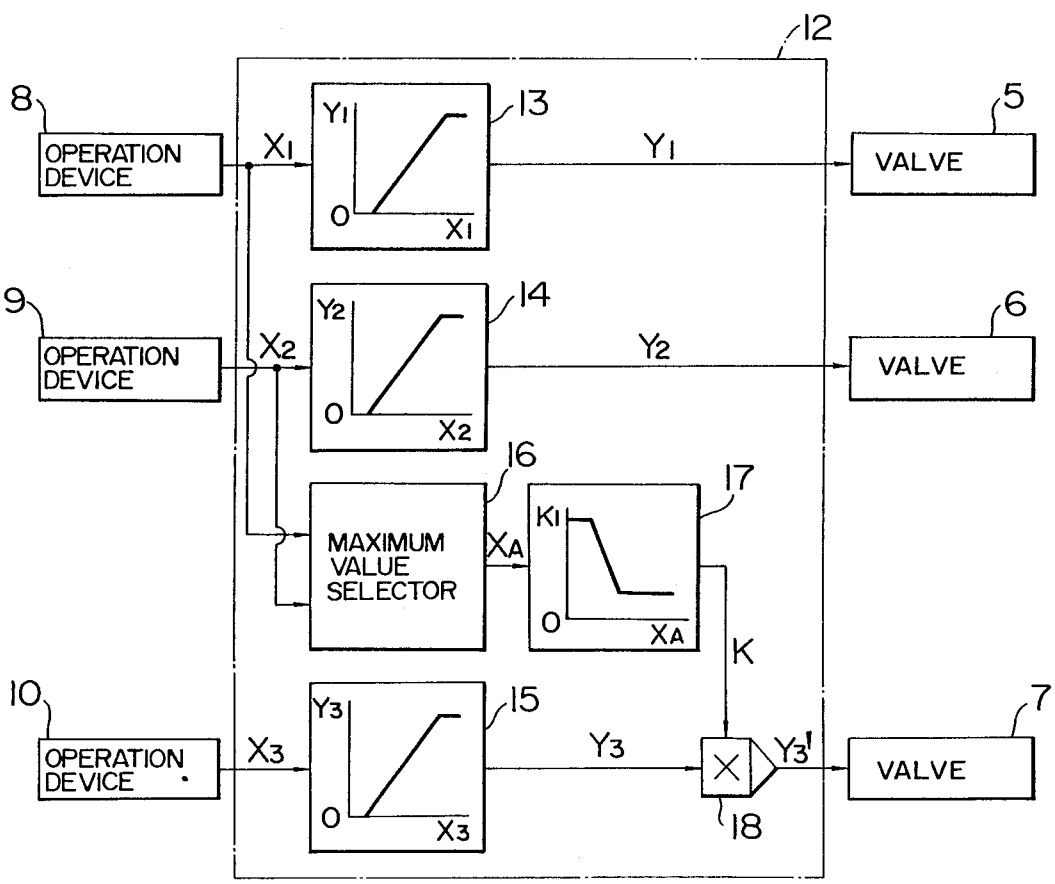
FIG. 2 is an explanatory view of a restriction means incorporated in a control unit of the hydraulic drive system shown in FIG. 1.

As shown in FIG. 2, the control unit 12 comprises a function table 13 connected to the operation device 8 for receiving a operation signal $X_1$ provided thereby and providing a control signal $Y_1$ to the directional control valve 5, a function table 14 connected to the operation device 9 for receiving an operation signal $X_2$ provided thereby and providing a control signal $Y_2$ to the directional control valve 6, and a function table 15 connected to the operation device 10 for receiving an operation signal $X_3$ providing thereby and providing a transient control signal $Y_3$. The control unit 12 further comprises a maximum valve selector 16 adapted to receive the operation signals $X_1$ and $X_2$ provided by the operation devices 8 and 9 and select larger one of them which is delivered as a maximum value signal $X_A$, a function table 17 responsive to the maximum value signal $X_A$ to provide a coefficient signal K, and a multiplier 18 adapted to receive the transient control signal $Y_3$ provided by the function table 15 and the coefficient signal K provided by the function table 17 for multiplication thereof and provide a control signal $Y_3'$ to the directional control valve 7.

In each of the function tables 13, 14 and 15, there is set a functional relation in which as the operation signal $X_1$, $X_2$ or $X_3$ increases in level, the control signal $Y_1$, $Y_2$ or $Y_3$ increases in level and finally reaches a maximum level, and in the function table 17, there is set a functional relation in which as the signal $X_A$ increases in level, the coefficient signal K decreases in level and finally reaches a minimum constant level.

With such structure of the control unit 12, the directional control valves 5, 6 and 7 can be actuated in a so-called half driving in which the valves are opened in a degree commensurate with the levels of the control signals $Y_1$, $Y_2$ and $Y_3$ as continuous electric signals.

When the operation devices 8, 9 and 10 are operated individually, the corresponding directional control valves 5, 6 and 7 are actuated so that the corresponding actuators 2, 3 and 4 are individually operated. Thus, a function of the circuit in parallel connection is secured.

When at least one of the operation devices 8 and 9 are operated while the operation device 10 is being operated and the control signal $Y_3'$ ($=Y_3$) is being provided to the valve 7, the corresponding one of the control signal $Y_1$ and $Y_2$ is provided to the corresponding valve 5 or 6, and the maximum value signal $X_A$ is provided from the maximum value selector 16 to the function table 17, which in turn provides the coefficient signal K commensurate with the level of the signal $X_A$ to the multiplier 18, at which the signal $Y_3$ provided by the function table 15 is multiplied by the coefficient signal K, so that the control signal $Y_3'$ delivered to the valve 7 is restricted to a smaller level than the transient control signal $Y_3$, whereby the degree of opening of the valve 7 is also restricted. This causes the fluid pressure in the inlet side of the valve 7 to increase so as to permit a sufficient rate of hydraulic fluid to be suppled to the actuator 2 or 3 through the corresponding directional control valve 5 or 6, so that the actuator 4 and actuator 2 or 3 can be simultaneously driven substantially independently of each other for combined operation of the associated working elements.

When all of the operation devices are not operated and held in neutral position, the bypass valve 11 is actuated to have an open position shown in FIG. 1 by a signal provided by an output section, not shown, of the control unit 12, so that the hydraulic fluid discharged from the pump 1 is returned to the reservoir through the bypass valve 11.

The above-referred simultaneous driving is considered suitable for performing combined operation of travelling and raising of a boom in a hydraulic excavator, for example. Assuming that the actuator 4 comprises a pair of travel motors and the actuator 2 comprises a boom cylinder, when the actuator 2 as the boom cylinder is intended to be driven during travelling, most hydraulic fluid would flow into the travel motors which are usually low in load pressure than the boom cylinder unless the maximum value selector 16, function table 17 and multiplier 18 are not provided, so that the raising of the boom by the boom cylinder cannot be achieved. According to the structure with the control unit 12 shown in FIG. 2, however, the level of the control signal $Y_3'$ delivered to the valve 7 is restricted as above-mentioned in the same condition, and thus the degree of opening of the valve 7 is restricted. This develops a relatively high hydraulic pressure in the inlet side of the valve 7 for the travel motors so as to permit a sufficient rate of hydraulic fluid to be supplied to the boom cylinder, so that simultaneous driving of the travel motors and boom cylinder can be performed substantially independently of each other for combined operation of travelling and boom raising.

In the above-described embodiment, the directional control valves 5, 6 and 7 have been explained as the solenoid operated valves actuated by electric signals, however, the invention is not limited to this specific form of the valves and each of them may be formed as a pilot operated valve actuated by a pilot signal generated by a solenoid operated proportional valve which is actuated by the singal provided by the control unit 12.

Figure 3:
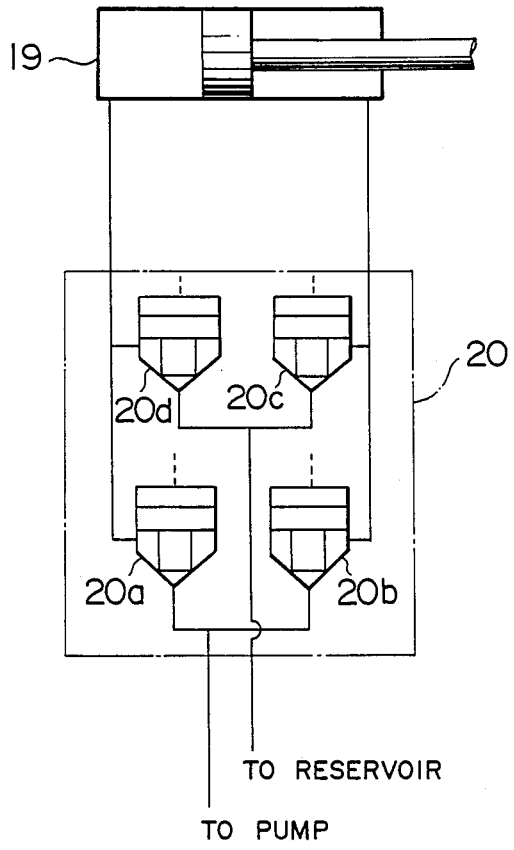
FIG. 3 is a schematic diagram showing a directional control valve of the logic valve type usable in the hydraulic drive system according to the present invention.

The directional control valves 5, 6 and 7 may be the spool type or the other type as far as the degree of opening can be regulated in accordance with the level of the control signal. By way of example, each of the directional control valves may comprise four logic valves as shown in FIG. 3. More specifically, the illustrated directional control valve 20 which is connected to a hydraulic cylinder 19 corresponding to one of the actuators 2, 3 and 4 comprises four logic valves 20*a*, 20*b*, 20*c* and 20*d*, which are connected in such a manner that when the logic valves 20*a* and 20*c* are turned ON, hydraulic fluid from a hydraulic pump not shown is supplied to the head side of the cylinder 19 through the valve 20*a* while the hydraulic in the rod side of the cylinder 19 is returned to a reservoir not shown through the valve 20*c*, and when the logic valves 20*b* and 20*d* are turned ON, the hydraulic fluid from the pump is supplied to the rod side of the cylinder 19 through the valve 20*b* while the hydraulic fluid in the head side is returned to the reservoir through the valve 20*d*. These logic valves may be of the type actuated directly by the associated control signal or the type actuated by a pilot pressure signal converted therefrom, and in any event, they must be of the type which regulates the degree of opening in accordance with the level of the control signal, so that when the level of the control signal is restricted by the restriction means according to the present invention, the degree of opening commensurate with the level of the control signal can be achieved. The structure of such proportionally controlled logic valve is known, and therefore detailed explanation is not set forth here.

Use of the directional control valve of the logic valve type permits clearances in movable portions to be considerably reduced compared with the spool valve type, and this makes it possible to use hydraulic fluid of higher pressure and thus hydraulic appliances of smaller size, which results in reduction in weight and manufacture cost of the hydraulic drive system.

The bypass valve 11 is arranged in the embodiment shown in FIG. 1, however, this can be dispensed with if there is provided a regulator by which a discharge rate of the pump 1 is controlled to become zero.

From the foregoing, it will be noted that the present invention permits simultaneous driving of hydraulic actuators to be performed substantially independently of each other for combined operation of working elements with the arrangement of one directional control valve for one actuator, and this ensures excellent operability and simplifies circuit structure compared with the conventional system, reducing the number of parts and manufacture cost.

It will also be noted that simplification of the circuit structure results in reduction in pressure loss, so that energy loss can be suppressed.

The second embodiment of the present invention will be explained with reference to FIGS. 4 and 5.

Figure 4:
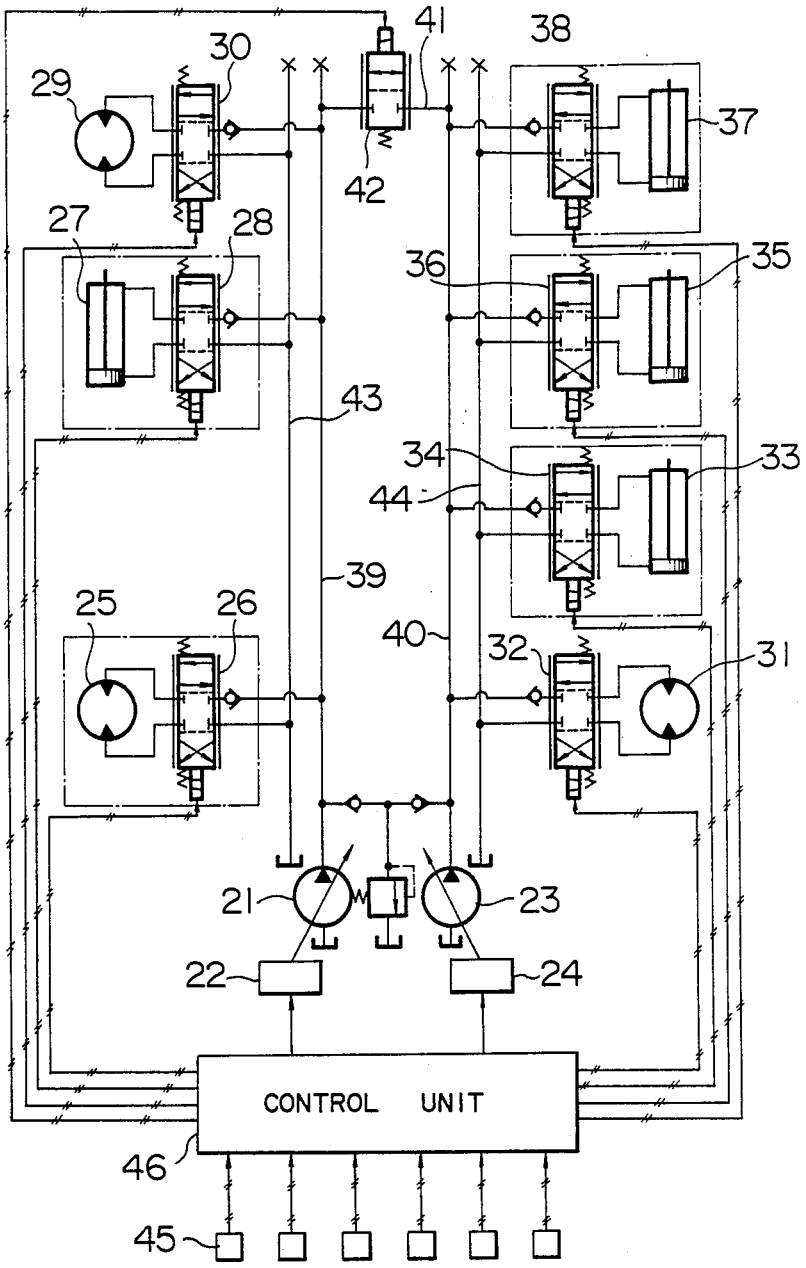
FIG. 4 is a circuit diagram showing a hydraulic drive system in another embodiment according to the present invention.

Referring to FIG. 4, reference numeral 21 designates a first hydraulic pump having a regulator 22 connected thereto for controlling a displacement volume of the pump 21, and reference numeral 23 designates a second hydraulic pump having a regulator 24 connected thereto for controlling a displacement volume of the pump 23. A swing hydraulic motor 25 is connected to the pump 21 through a swing directional control valve 26 for controlling a flow of hydraulic fluid supplied from the pump 21 to the swing motor 25; an arm hydraulic cylinder 27 is also connected to the pump 23 through an arm directional control valve 28 for controlling a flow of hydraulic fluid supplied from the pump 21 to the arm cylinder 27; and one of travel hydraulic motors, or left travel motor 29, for example, is further connected the pump 21 through a left travel directional control valve 30 for controlling a flow of hydraulic fluid supplied from the pump 21 to the left travel motor 29. The swing valve 26, arm valve 28 and left travel valve 30 are connected to the pump 21 in parallel with each other, and they are of the center block type in which ports connected to the pump 21 are center-blocked. These valves 26, 28 and 30 as well as the pump 21 constitute a first hydraulic circuit.

The swing valve 26 and arm valve 28 may be directly connected to the swing motor 25 and arm cylinder 27, respectively, as shown in alternate long and short dash lines, without use of any hydraulic hoses, thereby providing unitary valve and actuator structures.

A right travel hydraulic motor 31 is connected to the second pump 23 through a right travel directional control valve 32 for controlling a flow of hydraulic fluid supplied from the pump 23 to the right travel motor 31; a first or left boom hydraulic cylinder 33 is also connected to the pump 23 through a left boom directional control valve 34 for controlling a flow of hydraulic fluid supplied from the pump 23 to the first boom cylinder 33; a second or right boom hydraulic cylinder 35 is also connected to the pump 23 through a right boom directional control valve 36 for controlling a flow of hydraulic fluid supplied from the pump 23 to the second boom cylinder 35; and a bucket hydraulic cylinder 37 is further connected to the pump 23 through a bucket directional control valve 38 for controlling a flow of hydraulic fluid supplied from the pump 23 to the bucket cylinder 37. The right travel valve 32, left boom valve 34, right boom valve 36 and bucket valve 38 are connected to the pump 23 in parallel with each other, and they are of the center block type in which ports connected to the pump 23 are center-blocked. These valves 32, 34, 36 and 38 as well as the second pump 23 constitute a second hydraulic circuit.

The left boom valve 34, right boom valve 36 and bucket valve 38 may be directly connected with the first boom cylinder 33, second boom cylinder 35 and bucket cylinder 37, respectively, as shown in alternate long and short dash lines, without use of hydraulic hoses, thereby providing unitary valve and actuator structures.

The swing motor 25, arm cylinder 27, left and right travel motors 29 and 31, first and second boom cylinders 33 and 35 and bucket cylinder 37 are connected to swing, arm, left and right travel devices, boom and bucket of a hydraulic excavator not shown for operation thereof, respectively.

Reference numerals 39 and 40 represent hydraulic fluid supply lines for the pumps 21 and 23, respectively, and these supply lines 39 and 40 are connected in downstream portions thereof through communication lines 41, in which is situated valve means or on-off valve 42, for example, for interrupting communication through the line 41. The extremities of the supply lines 39 and 40 as well as those of return lines 43 and 44 are closed with blind patches.

Reference numeral 45 designates operation devices or command devices for providing operation signals for driving the respective actuators including the left travel motor 29, right travel motor 31, swing motor 25, arm cylinder 27, first boom cylinder 33, second boom cylinder 35 and bucket cylinder 37, and such operation signals are entered in a control unit 46 including an output section, which performs predetermined operations and judgements based on the operation signals and produces control signals for actuation of the valves 26, 28, 30, 32, 34, 36 and 38 and on-off valve 42, which are delivered to drive sections of these valves.

Figure 5:
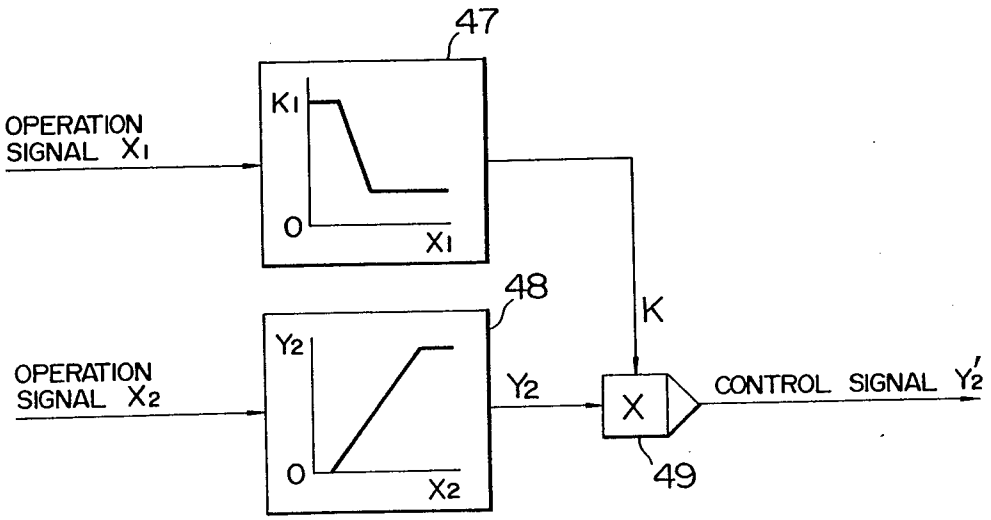
FIG. 5 is an explanatory view of a restriction means incorporated in a control unit of the hydraulic drive system shown in FIG. 4.

As shown in FIG. 5, the control unit 46 includes a first function table 47 in which is set beforehand a functional relation between an operation signal $X_1$ for driving a second hydraulic actuator or extending the first and second boom cylinders 33 and 35 for boom raising, for example, and a coefficient K, a second function table 48 in which is set beforehand a functional relation between an operation signal $X_2$ for driving a first hydraulic actuator or the left and right travel motors 29 and 31, for example, and a transient control signal $Y_2$ indicative of a normal target operation, and a multiplier 49 for multiplying the transient control signal $Y_2$ delivered from the second function table 48 by the coefficient K delivered from the first function table 47 and providing final control signals $Y_2'$ for driving the left and right travel motors 29 and 31. The functional relation set in the first function table 47 is determined such that the value of the coefficient K decreases as the level of the operation signal $X_1$ increases, and the functional relation set in the second table 48 is determined such that the level of the control signal $Y_2$ increases as the level of the operation signal increases. The first and second function tables 47 and 48 and the multiplier 49 constitute restriction means for restricting the level of the control signal $Y_2'$.

The control unit 46 is also operative to provide a control signal for actuation of the on-off valve 42 delivered to a drive section thereof when the control unit 46 receives the operation signals for driving the left and right travel motors 29 and 31 and another operation signal for driving the associated actuator, or the combined operation including travelling is required.

In such structure of the embodiment, when a combined operation of travelling and boom raising is desired, for example, an operation signal $X_1$ relating to the first and second boom cylinders 33 and 35 is provided from the corresponding operation device 45 to the control unit 46, while operation signals $X_2$ relating to the left and right travel motors 29 and 31 are provided from the corresponding operation devices 45 to the control unit 46. Responsive to the operation signals $X_1$ and $X_2$, the control unit 46 provides a control signal to the drive section of the on-off valve 42 to establish communication through the line 41 and also provides control signals to the drive sections of the left boom valve 34 and right boom valve 36. At the same time, the control unit 46 selects a coefficient K of a value commensurate with the operation signal $X_1$ relating to the first and second boom cylinders 33 and 35 based on the first function table 47 shown in FIG. 5 and selects a transient control signal $Y_2$ of a level commensurate with the operation signals $X_2$ relating to the left and right travel motors 29 and 31 based on the second function table 48, and then multiplies the control signal Y2 by the coefficient K at the multiplier. The resultant control signal $Y_2'$ is delivered to the drive sections of the left travel valve 30 and right travel valve 32.

Accordingly, the level of the final control signal $Y_2'$ is made smaller than the transient control signal $Y_2$, and thus the degree of opening of each of the left travel valve 30 and right travel valve 32 is restricted, increasing pressure of hydraulic fluid in the inlet side of each of the valves 30 and 32, so that boom raising operation requiring relatively large pressure can be performed along with travelling.

When the combined operation of the boom and arm without travelling is performed, the control unit 46 does not produce a control signal delivered to the drive section of the on-off valve 42, and therefore the line 41 is held in interrupted state, while the control unit 46 produces control signals delivered to the drive sections of the arm valve 28 and left and right boom valves 34 and 36, and therefore a hydraulic fluid discharged from the first pump 1 is supplied to the arm cylinder 27 through the arm valve 28 and a hydraulic fluid discharged from the second pump 2 is supplied to the first and second boom cylinders 33 and 35 through the left and right boom valves 34 and 36, thereby allowing simultaneous driving of the respective actuators to be performed completely independently of each other.

Thus, it will be noted that in the illustrated embodiment, substantially independent simultaneous driving of the left and right travel motors and the boom cylinder as well as the single driving of each actuator can be performed with the arrangement of one directional control valve for one hydraulic actuator, thereby lowering manufacturing cost.

It will also be noted that in the combined operation of the boom and arm, completely independent driving can be performed without their load pressures affecting each other and thus the first and second boom cylinders 33 and 35 and the arm cylinder can be driven without any unexpected change in operation speed, thereby achieving excellent operability.

Further, it will be noted that by appropriately determining the functional relations set in the first and second function tables 47 and 48 shown in FIG. 5, abrupt change in operation speeds of the left and right travel motors 29 and 31 which might occur when the boom is raised during travelling, for example, can be avoid, and thus excellent operability is attained also from this view point.

In the illustrated embodiment, the first function table 47, second function table 48 and multiplier 49 have been explained as restricting the level of the control signal $Y_2'$ delivered to the left and right travel valves 30 and 32 when boom raising or extension of the first and second boom cylinders 33 and 35 referred to as the second actuator is conducted during travelling or driving of the left and right travel motors 29 and 31 referred to as the first actuator, however, the invention is not limited to this specific form of the embodiment.

For example, the first actuator and second actuator may comprise the arm cylinder 27 and swing motor 25, respectively, and in this case, the operation signal for driving the swing motor 25 is entered in the first function table 47 as the operation signal $X_1$ shown in FIG. 5 and the operation signal for contracting the arm cylinder 27 is entered in the second function table 48 as the operation signal $X_2$, which results in restricting the degree of opening of the arm valve 28 for raising the fluid pressure in the inlet side of the arm valve 28, thereby enabling swinging to be performed during arm lowering operation.

The first actuator and second actuator may comprise the bucket cylinder 37 and first and second boom cylinders 33 and 35, respectively, and in this case the operation signal for driving the first and second boom cylinders 33 and 35 is entered in the first function table 47 as the operation signal $X_1$ shown in FIG. 5 and the operation signal for driving the bucket cylinder 37 is entered in the second function table 48 as the operation signal $X_2$, which results in restricting the degree of opening of the bucket valve 38 for raising of fluid pressure in the inlet side of the bucket valve 38, thereby allowing simultaneous driving of the boom and bucket cylinders to be performed substantially independently of each other for combined boom and bucket operation.

Similarly, the first actuator may comprise the left and right travel motors 29 and 31 and the second actuator may comprise at least one of the swing motor, arm cylinder 27 upon arm raising operation and bucket cylinder 37 upon bucket raising operation, while the first actuator may comprise at least one of the first and second boom cylinders 33, 35, arm cylinder 27 and bucket cylinder 37 upon lowing operation of the boom, arm and bucket, respectively, and the second actuator may comprise the left and right travel motors 29 and 31. Further, the first actuator may comprise one of the left and right travel motor 29 and 31 and the second actuator may comprise the first and second boom cylinders 33, 35, etc. upon boom raising operation, and in this case, combined operation of boom raising, etc., performed during steering can be achieved.

In summary, an actuator working at a small load among actuators to be driven simultaneously may be selected as the first actuator relating to the directional control valve of which the level of the operation signal and thus the degree of opening are restricted, and an actuator working at a large load may be selected as the second actuator, which causes high fluid pressure to be developed in the inlet side of the directional control valve for the actuator working at small load and enables sufficient hydraulic fluid to be supplied to the actuator working at large load, thereby allowing simultaneous driving of these actuators to be performed substantially independently of each other.

Figure 6:
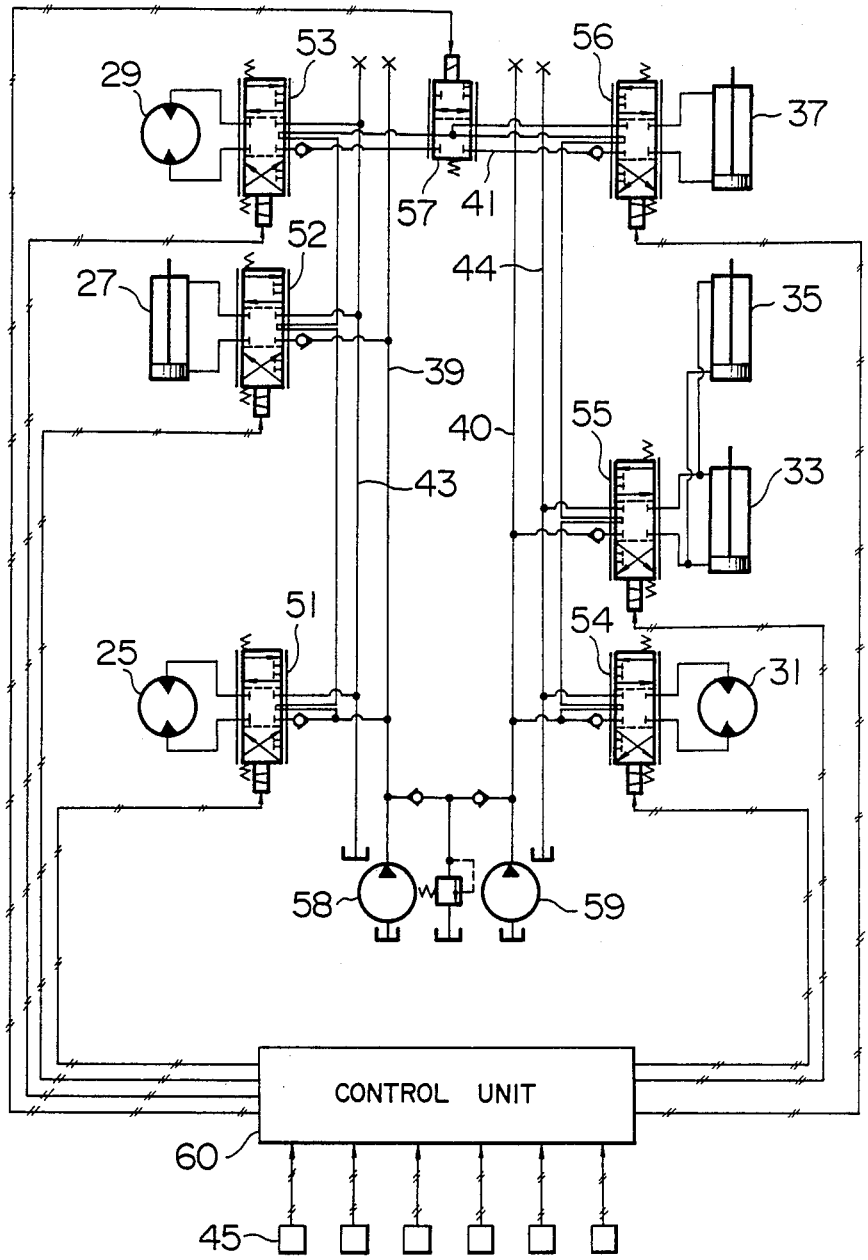
FIG. 6 is a circuit diagram showing a hydraulic drive system in still another embodiment according to the present invention.

FIG. 6 shows another embodiment of the present invention. In the embodiment shown in FIG. 4, each of the directional control valves 26, 28, 30, 32, 34, 36 and 38 connected to the respective actuators has been explained as being of the center block type. However, in the embodiment shown in FIG. 6, swing directional control valve 51, arm directional control valve 52, left travel directional control valve 53, right travel directional control valve 54, boom directional control valve 55 and bucket directional control valve 56 which are all of the center bypass type are situated in place of the valves 26, 28, 30, 32, 34, 36 and 38. An on-off valve 57 having a structure accommodated to the center bypass valve arrangement is connected in the communication line 41. Further, the boom valve is connected to the first and second boom cylinders 33 and 35 through hydraulic hoses as usual, so that the first and second boom cylinders can be driven by means of a single directional control valve 55. Fixed displacement hydraulic pumps 58 and 59 are arranged instead of the variable displacement pumps 21 and 23. Function tables similar to those shown in FIG. 5 are incorporated in a control unit 60.

It will be apparent that in this embodiment, the effect and advantage similar to those achieved by the embodiment shown in FIG. 4 are also attained.

Still another embodiment of the present invention will be explained with reference to FIG. 7, in which elements similar to those of the embodiment shown in FIG. 4 are designated by like reference characters, and the explanation thereof will be omitted.

In this embodiment, the swing directional control valve 26 is connected to the first hydraulic fluid supply line 39 at a portion 61 upstream of the other valves 28 and 30, and a second on-off valve 62 is connected in the supply line 39 immediately downstream of the portion 61 for interrupting communication through the supply line 39. A control unit 63 includes an output section operative to perform predetermined operations and judgements based on the operation signals delivered from the operation devices 45 and deliver control signals in accordance with the results to a drive section of the second on-off valve 62 as well as the drive sections of the directional control valves 26, 28, 30, 32, 34, 36 and 38 and on-off valve 42.

The control unit 63 includes restriction means having the first function table 47, second function table 48 and multiplier 49 shown in FIG. 5 like the embodiment shown in FIG. 4, so that when to perform combined operation of travelling and boom raising, the level of a control signal for driving the left and right travel motors corresponding to the first actuator can be restricted and thus the degree of opening of the left and right travel valves 30 and 32 can be restricted.

Figure 8:
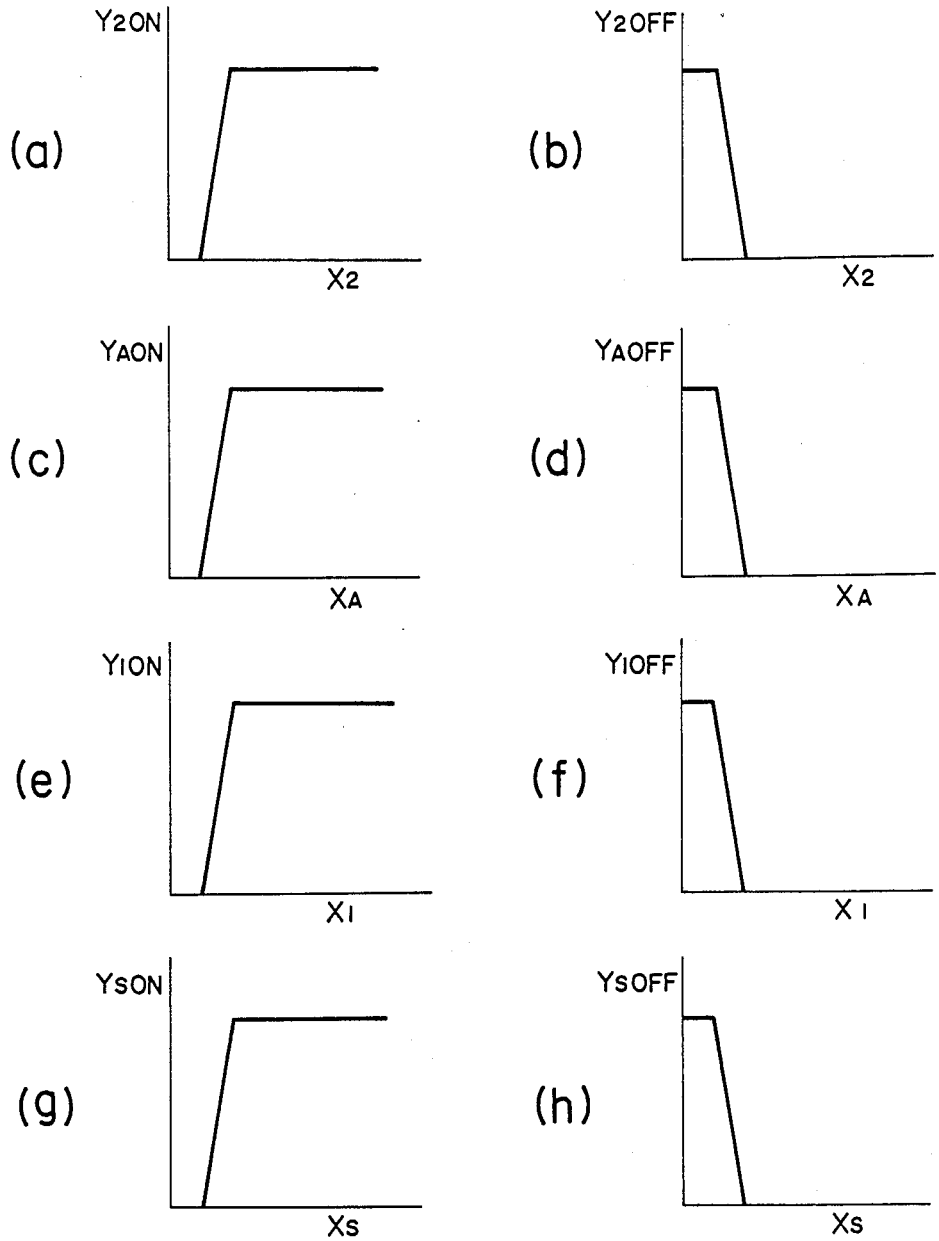
FIGS. 8 (*a*), (*b*), (*c*), (*d*), (*e*), (*f*), (*g*) and (*h*) are explanatory diagrams showning function tables set in a control unit of the hydraulic drive system shown in FIG. 7.

The control unit 63 also includes function tables in which the functional relations shown in FIGS. 8(*a*) through 8(*h*) are set. In this respect, FIGS. 8(*a*) and 8(*b*) shows a function table in which the functional relation between the operation signals $X_2$ for driving the left and right travel motors 29 and 31 and the control signals $Y_{2ON}$ and $Y_{2OFF}$ delivered to the on-off valves 42 and 62 is set; FIGS. 8(*c*) and 8(*d*) shows a function table in which the functional relation between the operation signal $X_A$ for driving the arm cylinder 27 and the control signals $Y_{AON}$ and $Y_{AOFF}$ delivered to the on-off valves 42 and 62 is set; FIGS. 8(*e*) and 8(*f*) shows a function table in which the functional relation between the operation signal $X_1$ for driving the boom cylinders 33 and 35 and the control signals $Y_{1ON}$ and $Y_{1OFF}$ delivered to the on-off valves 42 and 62 is set; and FIGS. 8(*g*) and 8(*h*) shows a function table in which the functional relation between the operation signal $X_S$ for driving the swing motor 25 and the control signals $Y_{SON}$ and $Y_{SOFF}$ delivered to the on-off valves 42 and 62 is set. In the function tables shown in FIGS. 8(*a*), 8(*c*), 8(*e*) and 8(*g*), the functional relations are determined such that as the levels of the operation signals increase, the levels of the control signals to the on-off valves 42 and 62 gradually increase and finally reach maximum values, and in the function tables shown in FIGS. 8(*b*), 8(*d*), 8(*f*) and 8(i h), the functional relations are determined such that as the levels of the operation signals increase, the levels of the control signals to the on-off valves 42 and 62 gradually decrease and finally reach minimum values.

Figure 9:
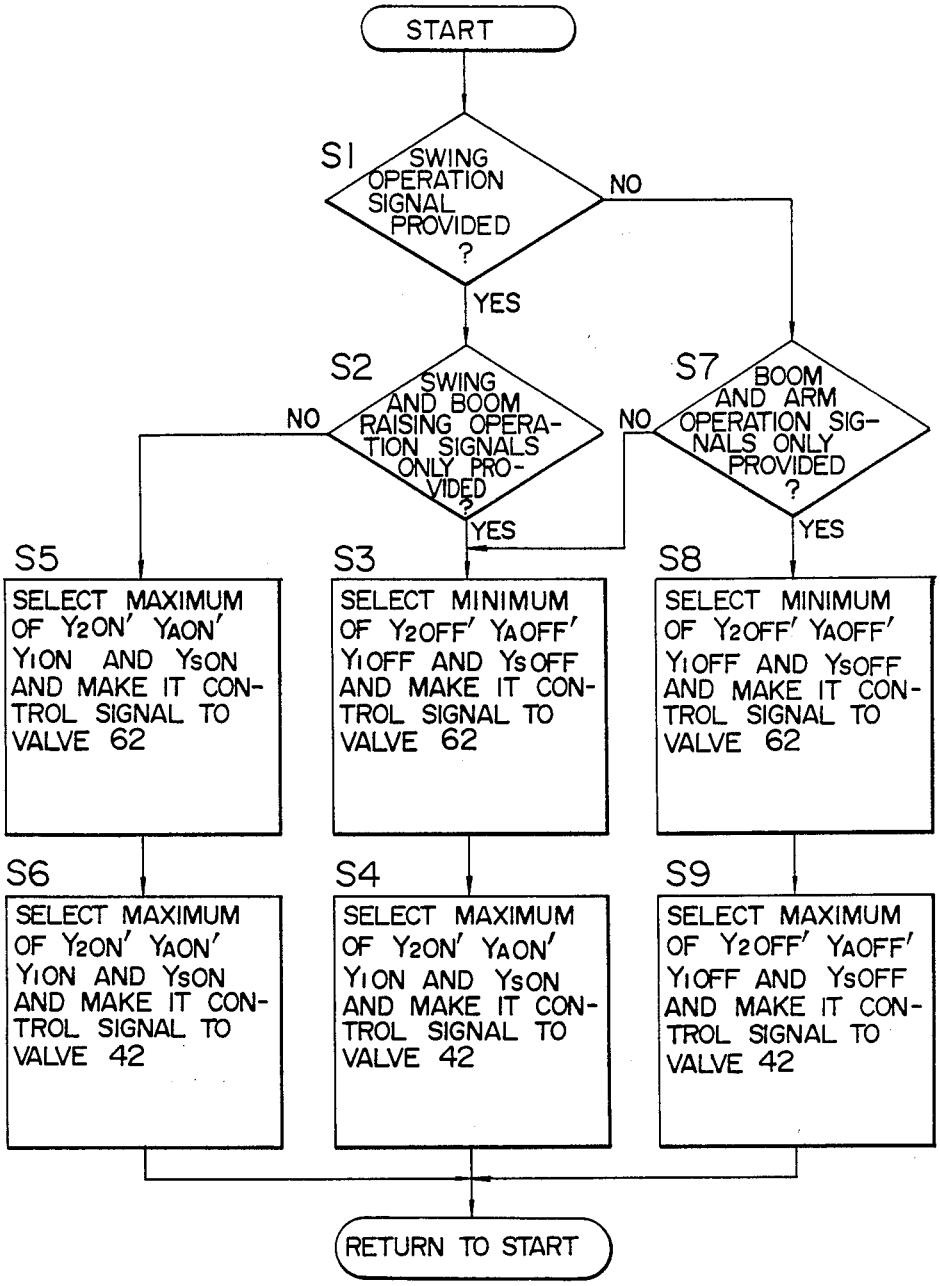
FIG. 9 is a flow chart showing steps of process performed in the control unit of the hydraulic drive system shown in FIG. 7.

The control unit includes selection means responsive to the operation signals for driving the respective actuators to select the control signals delivered to the on-off valves 42 and 62 based on the functional relations shown in FIGS. 8(*a*) through 8(*h*) in accordance with the procedure shown in FIG. 9.

Pressure sensors 64 and 65 are connected to the hydraulic fluid supply lines 39 and 40 for sensing the discharge pressures of the first and second pumps 21 and 23. In this respect, there is provided in the control unit 63 means of the known structure for changing setting of a cut-off pressure for the first pump 64 based on the operation signals for driving predetermined actuators other than the swing motor 25, for example, with the signal delivered from the pressure sensor 64 being entered in the changing means, thereby effecting cut-off control of pressure.

In the embodiment with such structure, when combined operation of travelling and boom raising is conducted, for example, the operation signal $X_1$ relating to the first and second boom cylinders 33 and 35 is delivered from the corresponding operation device 45 to the control unit 63, while the operation signals $X_2$ relating to the left and right travel motors 29 and 31 are delivered from the corresponding operation devices 45 to the control unit 63. Responsive to such operation signals, the control unit 63 carries out the procedure shown in FIG. 9. More specifically, in step S1, it is judged whether or not the operation signal for driving the swing motor 25 is delivered from the corresponding operation device 45 to the control unit 63. In this case, such signal is not delivered, and therefore the procedure proceeds to step S7, in which it is judged whether or not the operation signals for driving the first and second boom cylinders 33 and 35 and the arm cylinder 27 only are delivered. In this case, such signals are not delivered, the procedure proceeds to steps S3 and S4. In step S3, minimum value of the control signal $Y_{2OFF}$, $Y_{AOFF}$, $Y_{1OFF}$ and $Y_{SOFF}$ delivered from the function tables shown in FIGS. 8(*b*), 8(*d*), 8(*f*) and 8(*h*) is selected (in this case, the operation signals corresponding to $Y_{AOFF}$ and $Y_{SOFF}$ are not entered in the control unit 63), and the selected signal is made a control signal delivered to the on-off valve 62. Thus, the on-off valve 62 is held in open position shown in FIG. 7. In step S4, maximum value of the control signal $Y_{2ON}$, $Y_{AON}$, $Y_{SON}$ delivered from the function tables shown in FIGS. 8(*a*), 8(*c*), 8(*e*) and 8(*g*) is selected (in this case, the operation signals corresponding to $Y_{AON}$ and $Y_{SON}$ are not entered in the control unit 63), and the selected signal is made a control signal delivered to the on-off valve 42. Thus, the on-off valve 42 is switched from the closed position shown in FIG. 7 to the open position, thereby establishing communication through the line 41.

At the same time, the control signal corresponding to the operation signal $X_1$ is provided to the respective drive sections of the left and right boom directional control valves 34 and 36 in a usual manner, while the control signals of restricted levels obtained by processing the operation signals $X_2$ by the restriction means shown in FIG. 5 are delivered to the respective drive sections of the left and right travel directional control valves 30 and 32. This increases fluid pressure in the inlet side of the valves 30 and 32, so that boom raising operation requiring a relatively large pressure can be performed during travelling.

Combined operation of the actuators other than the travel motors is conducted as follows. In step S1 shown in FIG. 9, it is judged whether or not the operation signal for driving the swing motor 25 is delivered from the corresponding operation device 45 to the control unit 63, and when this is satisfied, the procedure proceeds to step S2, in which it is judged whether or not the operation signals for driving the swing motor 25 and driving the boom cylinders 33 and 35 for boom raising only are provided, and when this is satisfied, the procedure proceeds to steps S3 and S4. In step S3, minimum value of the control signals $Y_{2OFF}$, $Y_{AOFF}$, $Y_{1OFF}$ and $Y_{SOFF}$ delivered from the function tables shown in FIGS. 8(*b*), 8(*d*), 8(*f*) and 8(*h*) is selected (in this case, the operation signals corresponding to $Y_{2OFF}$ and $Y_{AOFF}$ are not entered in the control unit 63), and the selected signal is made a control signal delivered to the drive section of the on-off valve 62. Thus, the on-off valve 62 is held in closed position shown in FIG. 7, maintaining communication through the supply line 39. In step S4, maximum value of the control signals $Y_{2ON}$, $Y_{AON}$, $Y_{1ON}$ and $Y_{SON}$ delivered from the function tables shown in FIGS. 8(*a*), 8(*c*), 8(*e*) and 8(*g*) is selected (in this case, the operation signals corresponding to $Y_{2ON}$ and $Y_{AON}$ are not entered in the control unit 63), and the selected signal is made a control signal delivered to the drive section of the on-off valve 42. Thus, the on-off valve 42 is switched from the closed position shown in FIG. 7 to the open position, establishing communication through the line 41. This permits hydraulic fluids supplied from the first and second pumps 21 and 23 to be combined for performing combined operation of swinging and boom raising operation.

When the requirement in step S2 is not satisfied, or when the operation signals for driving the swing motor 48 and/or boom cylinders 33 and 35 as well as at least one of the arm cylinder 27, travel motors 29 and 31, etc. are provided, the procedure proceeds to steps S5 and S6. In step S5, maximum value of the control signal $Y_{2ON}$, $Y_{AON}$, $Y_{1ON}$ and $Y_{SON}$ delivered from the function tables shown in FIGS. 8(*a*), 8(*c*), 8(*e*) and 8(*g*) is selected, and the selected signal is made a control signal delivered to the drive section of the on-off valve 62. Thus, the on-off valve 62 is switched from the open position shown in FIG. 7 to the closed position, interrupting communication through the supply line 39. In step S6, maximum value of the control signal $Y_{2ON}$, $Y_{AON}$, $Y_{1ON}$ and $Y_{SON}$ delivered from the function tables shown in FIGS. 8(*a*), 8(*c*), 8(*e*) and 8(*g*) is selected as well, and the selected signal is made a control signal delivered to the drive section of the on-off valve 42. Thus, the on-off valve 42 is switched to the open position, establishing communication through the line 41. In such a state, the hydraulic fluid discharged from the first pump 21 can be supplied solely to the swing motor 25 through the swing valve 26, while the hydraulic fluid discharged from the second pump 23 can be supplied to the travel motors 29 and 31 through the valves 30 and 32, boom cylinders 33 and 35 through the valves 34 and 36 and arm cylinder 27 through the valve 28, thereby enabling simultaneous driving of the swing motor and the travel motors, boom cylinders, arm cylinder, etc., to be performed completely independently of each other for combined operation of swinging, travelling, boom and arm operation, etc.

When the requirement is not satisfied in step S1, the procedure proceeds to step S7, in which it is judged whether or not the operation signals for driving the boom cylinders 33 and 35 and arm cylinder 27 only are provided, and when the requirement is not satisfied, the above-mentioned steps S3 and S4 follows. In this case, both of the on-off valves 42 and 52 are opened, and the combined operation of the actuators including the boom cylinders 33 and 35 and arm cylinder 27 but the swing motor 25 can be achieved with the combined fluids from the first and second pumps 21 and 23.

When the requirement is satisfied in step S7, or when the operation signals for driving the boom cylinders 33 and 35 and arm cylinder 27 only are provided, the procedure proceeds to steps S8 and S9. In step S8, minimum value of the control signals $Y_{2OFF}$, $Y_{AOFF}$, $Y_{1OFF}$ and $Y_{SOFF}$ delivered from the function tables shown in FIGS. 8(*b*), 8(*d*), 8(*f*) and 8(*h*) are selected, and the selected signal is made a control signal delivered to the drive section of the on-off valve 62. Thus, the on-off valve 62 is held in open position. In step S9, similarely, minimum value of the control signals $Y_{2OFF}$, $Y_{AOFF}$, $Y_{1OFF}$ and $Y_{SOFF}$ delivered from the function tables shown in FIGS. 8(*b*), 8(*d*), 8(*f*) and 8(*h*) are selected, and the selected signal is made a control signal delivered to the drive section of the on-off valve 42. Thus, the on-off valve 42 is held in closed position, interrupting communication through the line 41. In such a state, the hydraulic fluid discharged from the first pump 21 is supplied to the arm cylinder 27 through the valve 28, while the hydraulic fluid discharged from the second pump 23 is supplied to the boom cylinders 33 and 35 through the valves 34 and 36, thereby enabling simultaneous driving of the arm and boom cylinders to be performed completely independently of each other for combined operation of the arm and boom.

Additionally, in the above-mentioned combined operations, when the on-off valve 62 is closed, the hydraulic fluid discharged from the first pump 21 might be relieved, which results in energy loss, and thus to avoid the situation, the pressure of hydraulic fluid discharged from the first pump 1 preferably would be cut-off by the above-mentioned changing means incorporated in the control unit 63.

In the embodiment with such structure, it will be apparent that the effect and advantage similar to those of the embodiment shown in FIG. 4 are attained, and besides, when combined operation of swinging and other operations is conducted, the hydraulic fluid from the first pump 21 can be supplied solely to the swing motor 25, thereby ensuring complete independent swing operation.

Figure 7:
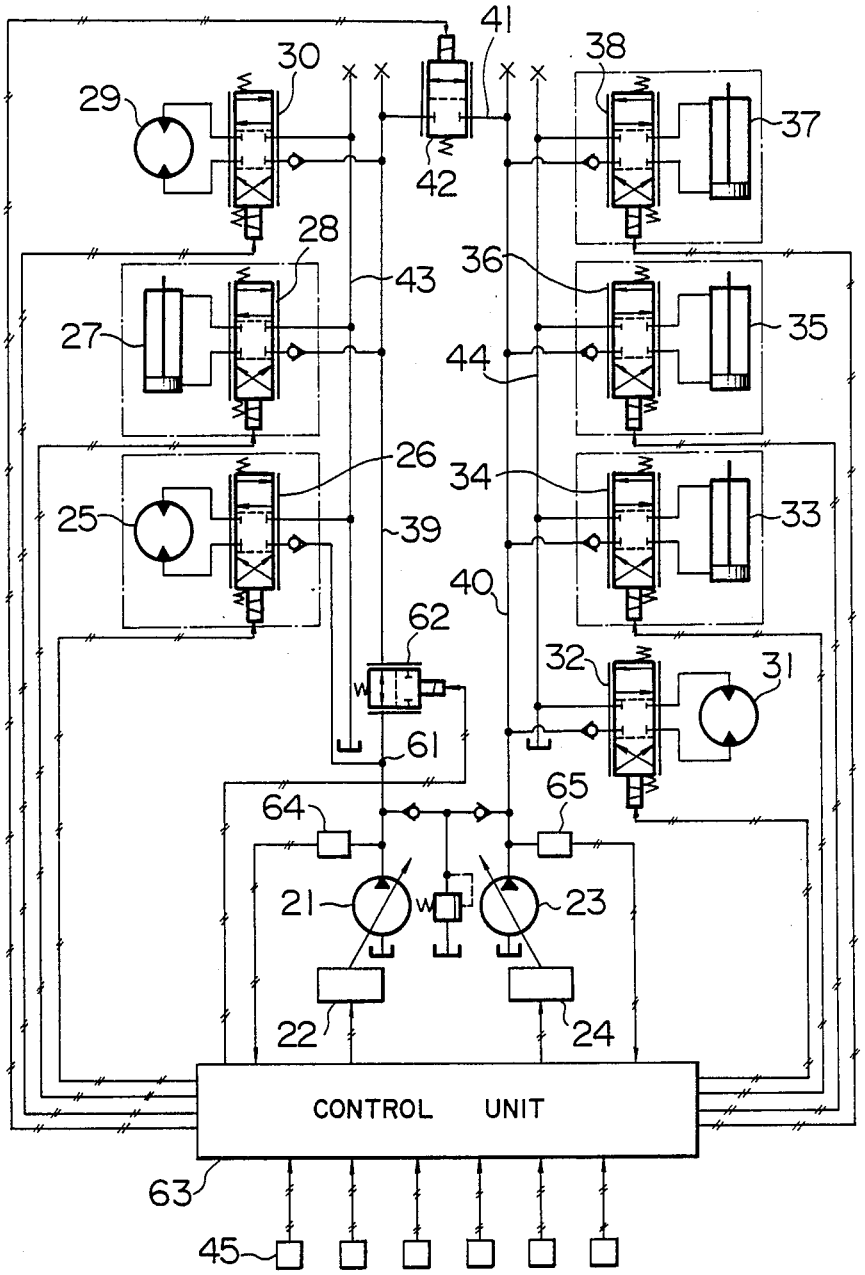
FIG. 7 is a circuit diagram showing a hydraulic drive system in a further embodiment according to the present invention.

A further embodiment of the present invention will be explained with reference to FIG. 10, in which elements similar to those of the embodiments shown in FIGS. 4 and 7 are designated by like reference characters, and the explanation thereof will be omitted.

In the embodiment, the left travel directional control valve 30 is not directly connected to the first hydraulic fluid supply line 39, but connected to the second hydraulic fluid supply line 40 through a second communication line 72 at a portion 71 downstream of a portion 70 where the right travel directional control valve 31 is connected to the second supply line 40 through a third communication line 73. The right travel valve 31 is arranged in parallel with the other directional control valves 34, 36 and 38 like the preceding embodiments. A second on-off valve 73 for interrupting communication through the second supply line 40 is connected therein immediately downstream of the connecting portion 71, and a third on-off valve 75 for interrupting communication through the second supply line 40 as well is connected therein between the portions 70 and 71. A check valve 76 for preventing reverse flow is connected immediately downstream of the on-off valve 75.

The control unit 77 includes an output section operative to perform predetermined operations and judgements based on the operations signals delivered from the operation devices 45 and deliver control signals in accordance with the results to the drive sections of the second and third on-off valves 74 and 75 as well as those of the directional control valves 26, 28, 30, 32, 34 36 and 38 and on-off valve 42.

The control unit 77 includes, like the embodiment shown in FIG. 4, restriction means having the first function table 47, second function table 48 and multiplier 49 as shown in FIG. 5 for, when to perform simultaneous driving of the first and second actuators, restricting the level of the control signal for driving the first actuator, thereby restricting the degree of opening of the corresponding directional control valve. In this embodiment, however, the first actuator comprises the arm cylinder 27 and the second actuator comprises the swing motor 25, and the operation signal for driving the swing motor 25 is entered in the first function table 47 as as the operation signal $X_1$ shown in FIG. 5 while the operation signal for contracting the arm cylinder 27 is entered in the second function table 48 as the operation signal $X_2$, so that simultaneous driving of the arm cylinder and swing motor can be performed substantially independently of each other for combined operation of arm lowering and swinging operation. Instead of and/or in addition to such first and second actuators, the bucket cylinder 37 may be selected as the first actuator and the first and second boom cylinders 33 and 35 may be selected as the second actuator.

Figure 11:
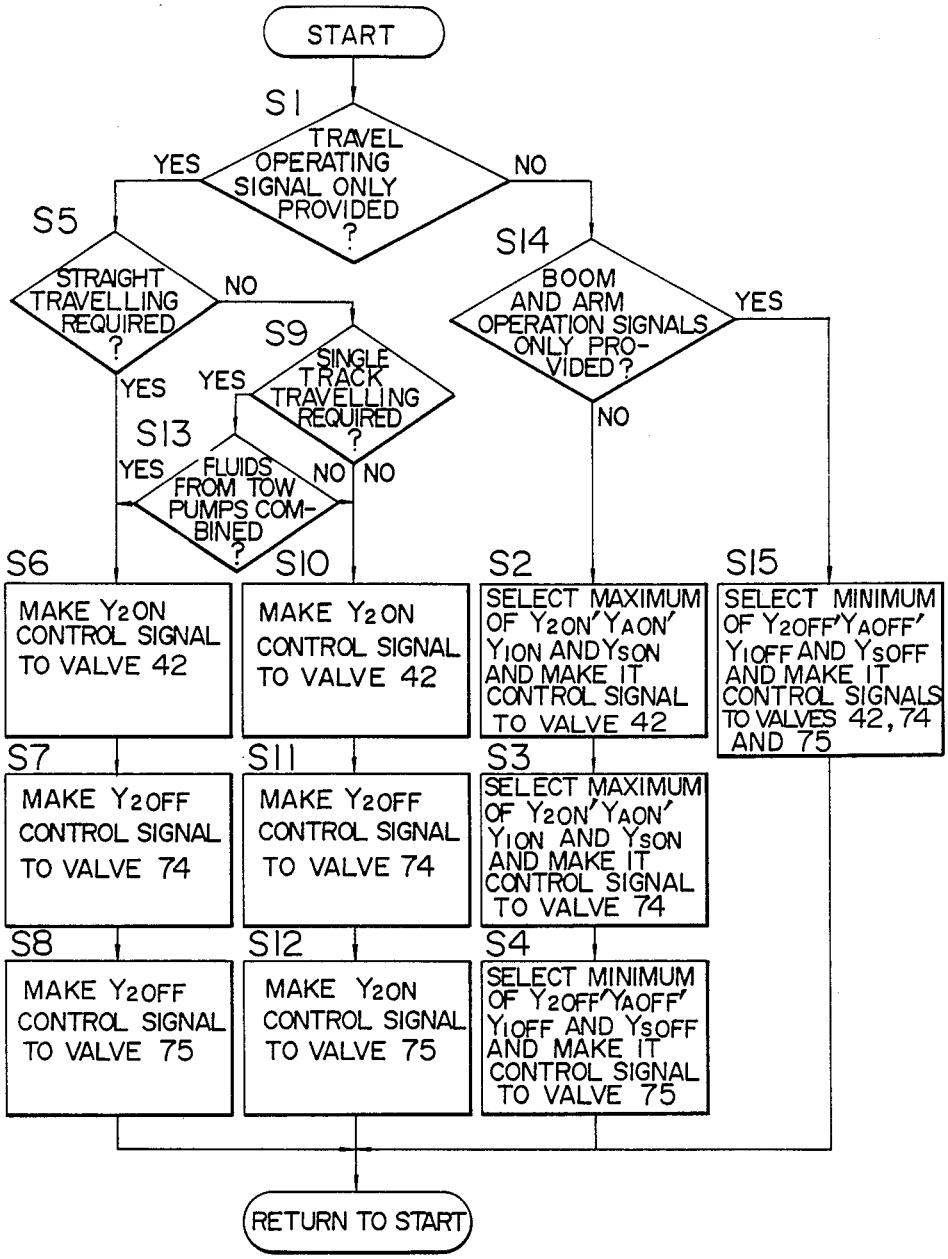
FIG. 11 is a flow chart showing steps of process performed in the control unit of the hydraulic drive system shown in FIG. 10.

Like the embodiment shown in FIG. 7, the control unit 77 also includes function tables in which the functional relations shown in FIGS. 8(*a*) through 8(*h*) are set, and selection means responsive to the operation signals for driving the respective actuators to select the control signals delivered to the on-off valves 42, 74 and 75 based on the functional relations shown in FIGS. 8(*a*) through 8(*h*) in accordance with the procedure shown in FIG. 11.

In the embodiment with such structure, when combined operation of travelling and other operations or boom raising, for example, is conducted, the operation signal $X_1$ relating to the first and second boom cylinders 33 and 35 is delivered from the corresponding operation device 45 to the control unit 77, while the operation signals $X_2$ relating to the left and right travel motors 29 and 31 are delivered from the corresponding operation devices 45 to the control unit 77. Responsive to such operation signals, the control unit 77 carries out the procedure shown in FIG. 9. More specifically, in step S1, it is judged whether or not the operation signals for driving the travel motors only are provided. When the requirement is not satisfied, the procedure proceeds to step S13, in which it is judged whether or not the operation signals for driving the boom and arm cylinders only are provided. When the requirement is satisfied, the procedure proceeds to steps S2, S3 and S4 before returning to the start. In step S2, maximum value of the control signal $Y_{2ON}$, $Y_{AON}$, $Y_{1ON}$ and $Y_{SON}$ delivered from the function tables shown in FIGS. 8(*a*), 8(*c*), 8(*e*) and 8(*g*) is selected (in this case, the operation signals corresponding to $Y_{AON}$ and $Y_{SON}$ are not entered in the control unit 77), and the selected signal is made a control signal delivered to the on-off valve 42. Thus, the on-off valve 42 is switched from the closed position shown in FIG. 10 to the open position, thereby establishing communication through the line 41. In step S3, similarly, maximum value of the control signal $Y_{2ON}$, $Y_{AON}$, $Y_{1ON}$ and $Y_{SON}$ delivered from the function tables shown in FIGS. 8(*a*), 8(*c*), 8(*e*) and 8(*g*) is selected (in this case, the operation signals corresponding to $Y_{AON}$ and $Y_{SON}$ are not entered in the control unit 77), and the selected signal is made a control signal delivered to the on-off valve 74. Thus, the on-off valve 74 is switched to the closed position. IN step S4, minimum value of the control signal $Y_{2OFF}$, $Y_{AOFF}$, $Y_{1OFF}$ and $Y_{SOFF}$ delivered from the function tables shown in FIGS. 8(*b*), 8(*d*), 8(*f*) and 8(*h*) is selected (in this case, the operation signals corresponding to $Y_{AOFF}$ and $Y_{SOFF}$ are not entered in the control unit 77), and the selected signal is made a control signal delivered to the on-off valve 75. Thus, the on-off valve 75 is held in open position shown in FIG. 10. Thus, the hydraulic fluid discharged from the second pump 23 is supplied to the left and right travel motors 29 and 31 through the second and third communication lines 72 and 73 and the first and second travel valves 30 and 32, respectively, while the hydraulic fluid discharged from the first pump 21 is supplied to the first and second boom cylinders 33 and 35 through the first communication line 41 and the boom valves 34 and 36, thereby allowing simultaneous driving of the travel motors and boom cylinders to be performed completely independent of each other for combined operation of travelling and boom raising operation.

It will be noted that when to perform combined operation of travel and the other operation such as boom lowering and arm operation, the control unit 77 functions similarly to permit the hydraulic fluid from the second pump 23 to be supplied to the travel motors and the hydraulic fluid from the first pump 21 to be supplied to the other corresponding actuators, thereby enabling simultaneous driving thereof to be performed completely independently of each other.

When combined operation of the boom and arm without travelling is conducted, the requirement is satisfied in step S14 and the procedure proceeds to step S15. In step S15, minimum value of the control signal $Y_{2OFF}$, $Y_{AOFF}$, $Y_{1OFF}$ and $Y_{SOFF}$ delivered from the function tables shown in FIGS. 8(*b*), 8(*d*), 8(*f*) and 8(*h*) is selected, and the selected signal is made control signals delivered to the drive sections of the on-off valves 42, 74 and 75. Thus, the on-off valve 42 is closed and the on-off valves 74 and 75 are opened, interrupting communication through the line 41. On the other hand, the control signals are delivered from the control unit 77 to the drive section of the arm directional control valve 28 and those of the left and right boom directional control valves 34 and 36, so that the hydraulic fluid from the first pump 21 is supplied to the arm cylinder 27 through the arm valve 28 while the hydraulic fluid from the pump 23 is supplied to the first and second boom cylinders 33 and 35 through the left and right boom valves 34 and 36, thereby enabling simultaneous driving of the arm and boom cylinders to be performed completely independent of each other for combined operation of boom and arm.

When the operation of travelling only is conducted, the procedure proceeds from step S1 to S5, in which it is judged whether or not straight travelling is required or the operation signals for driving both of the left and right travel motors 29 and 31 are provided to the control unit 77. When the requirement is satisfied, the procedure proceeds to steps S6, S7 and S8 before returning to start. In step S6, the control signal $Y_{2ON}$ delivered from the function table shown in FIG. 8(*a*) is made a control signal delivered to the drive section of the on-off valve 42. In step S7, the control signal $Y_{2OFF}$ delivered from the function table shown in FIG. 8(*b*) is made a control signal delivered to the drive section of the on-off valve 74. In step S8, the control signal $Y_{2OFF}$ delivered from the function table shown in FIG. 8(*b*) is made a control signal delivered to the drive section of the on-off valve 75. Thus, the on-off valve 42 is opened to establish communication through the line 41, and the on-off valves 74 and 75 are opened to establish communication through the secodn hydraulic fluid supply line 40 for the pump 23, so that the hydraulic fluid discharged from the first and second pumps 21 and 23 are supplied to the left and right travel motors 29 and 31 through the first, second and third communication lines 41, 72 and 73, thereby enabling desired straight travelling to be performed.

When the requirement is not satisfied in step S5, the procedure proceeds to step S9, in which it is judged whether or not a single track travelling is required or the operation signal for driving only one of the left and right travel motors 29 and 31 is entered in the control unit 77. When the requirement is not satisfied, the procedure proceeds to steps S10, S11 and S12 before returning to start. In step S10, the control signal $Y_{2ON}$ delivered from the function table shown in FIG. 8(*a*) is made a control signal delivered to the drive section of the on-off valve 42. In step S11, the control signal $Y_{2OFF}$ delivered from the function table shown in FIG. 8(*b*) is made a control signal delivered to the drive section of the on-off valve 74. In step S12, the cotnrol signal $Y_{2ON}$ delivered from the function table shown in FIG. 8(*a*) is made a control signal delivered to the drive section of the on-off valve 75. Thus, the on-off valves 42 and 74 are opened and the on-off valve 75 is closed, so that the hydraulic fluid discharged from the first pump 21 can be supplied to the left travel motor 29 through the first hydraulic fluid supply line 39, first communication line 41, second hydraulic fluid supply line 40, second communication line 72 and left travel directional control valve 30, while the hydraulic fluid discharged from the second pump 23 can be supplied to the right travel motor 31 through the second supply line 40, third communication line 73 and right travel directional control valve 32, thereby enabling travelling in a desired direction to be performed.

When the requirement for a single track travelling is satisfied in step S9, the procedure proceeds to step S13, in which it is judged whether or not hydraulic fluids from the two pumps 21 and 23 are combined. When the requirement is satisfied, the procedure proceeds to the above-mentioned steps S6, S7 and S8 and when the requirement is not satisfied, the procedure proceeds to the above-mentioned steps S10, S11 and S12. In steps S6, S7 and S8, the on-off valves 42, 74 and 75 are all opened, so that the hydraulic fluids from the first and second pumps 21 and 23 are combined and supplied to one of the left and right travel motors 29 and 31. In steps S10, S11 and S12, the on-off valves 42 and 74 are opened and the on-off valve 75 is closed, so that the hydraulic fluid from one of the pumps 21 and 23 is supplied to the corresponding one of the left and right travel motors 29 and 31.

In the embodiment with such structure, it will be apparent that the effect and advantage similar to those of the embodiment shown in FIG. 4 are attained, and besides, the combined operation of travelling and other operations is conducted, the hydraulic fluid from the second pump 23 can be supplied to the travel motors while the hydraulic fluid from the first pump 21 can be supplied to the other corresponding actuators, thereby ensuring complete independent travelling.

Even further embodiments of the present invention will be explained with reference to FIGS. 12 and 13, in which elements similar to those of the preceding embodiments are designated by like reference characters, and explanation thereof will be omitted.

Figure 10:
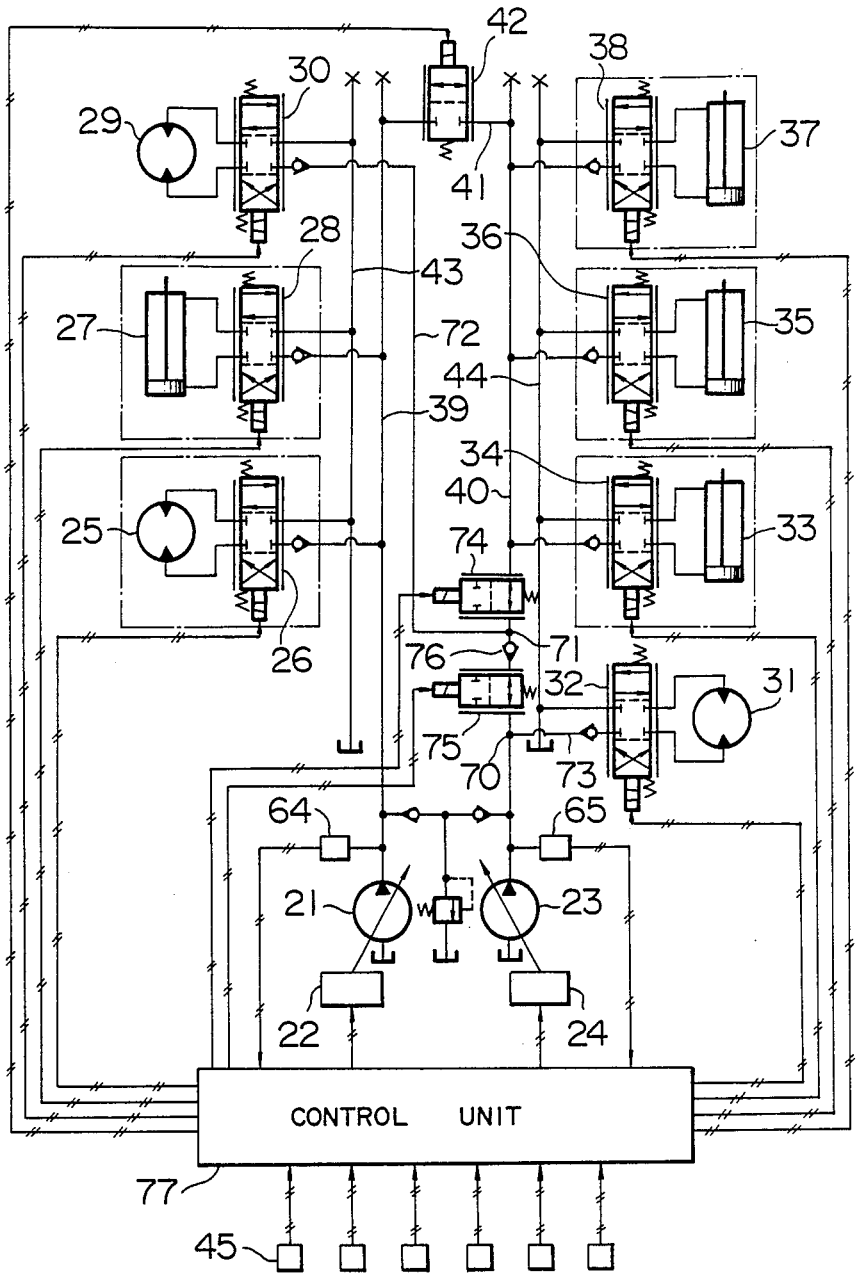
FIG. 10 is a circuit diagram showing a hydraulic drive system in a still further embodiment according to the present invention.
Figure 12:
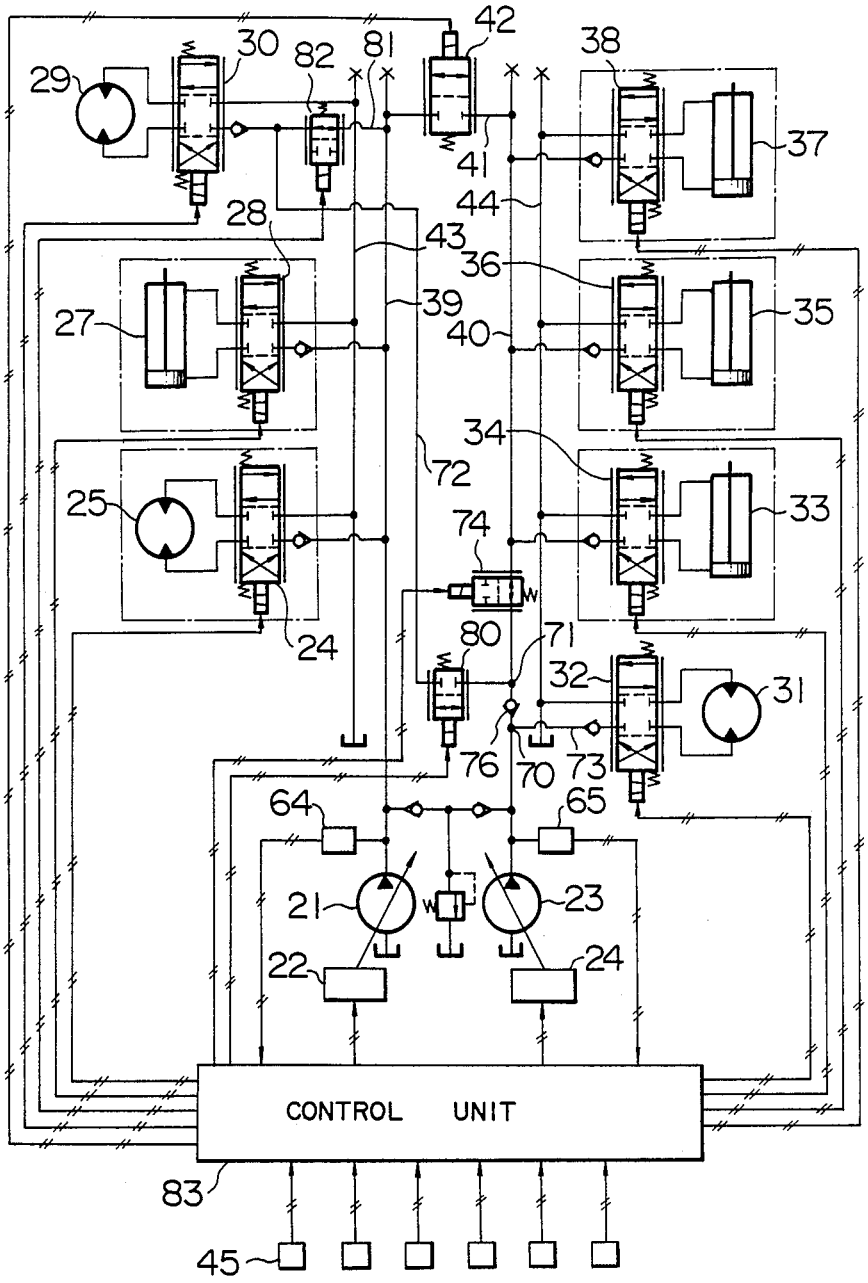
FIG. 12 is a circuit diagram showing a hydraulic drive system in an even further embodiment according to the present invention.

In the embodiment shown in FIG. 12, the on-off valve 75 arranged in the embodiment shown in FIG. 10 is not provided. Instead, a fourth valve means or on-off valve 80 is connected in the second communication line 72 for interrupting communication therethrough, and the left travel directional control valve 30 is further connected to the first supply line 39 through a fourth communication line 81, in which is connected a fifth valve means or on-off valve 82 for interrupting communication through the fourth line 81.

A control unit 77 includes function tables in which the functional relations shown in FIGS. 8(*a*) through 8(*h*) are set, and selection means responsive to the operation signals for driving the respective actuators to select the control signals delivered to the on-off valves 42, 74, 80 and 82 based on the functional relations shown in FIGS. 8(*a*) through 8(*h*).

In this embodiment shown in FIG. 12, by delivering the control signals for opening the on-off valves 42 and 80 and closing the on-off valves 74 and 82 from the control unit 83, the hydraulic fluid from the second pump 23 can be supplied to the travel motors 29 and 31 while the hydraulic fluid from the first pump 21 to the other actuators, so that simultaneous driving of the travel motors and the other actuators can be performed completely independently of each other for combined operation of traveling and other operations. By providing the control signals for closing the on-off valves 42, 80 and 82 and opening the on-off valve 74 from the control unit 83, the hydraulic fluid from the first pump 21 can be supplied to the arm cylinder 27 while the hydraulic fluid from the second pump 23 can be supplied to the boom cylinders 33 and 34, so that simultaneous driving of the arm and boom cylinders can be performed completely independently of each other for combined operation of the boom and arm without travelling.

Also, by closing the on-off valves 42 and 74, it is possible to perform operation of travelling only, and by opening the on-off valve 80 and 82 in this state, the hydraulic fluids from the first and second pumps 21 and 23 can be combined for straight travelling, or the combined fluids can be supplied to one of the left and right travel motors 29 and 31 for single track travelling, while by closing the on-off valve 80 and opening the on-off valve 82 in such a state, travelling in a desired direction or a single track travelling with one pump can be performed.

It will be noted that the effect and advantage similar to those of the above-mentioned embodiment shown in FIG. 10 can be attained also in this embodiment.

Figure 13:
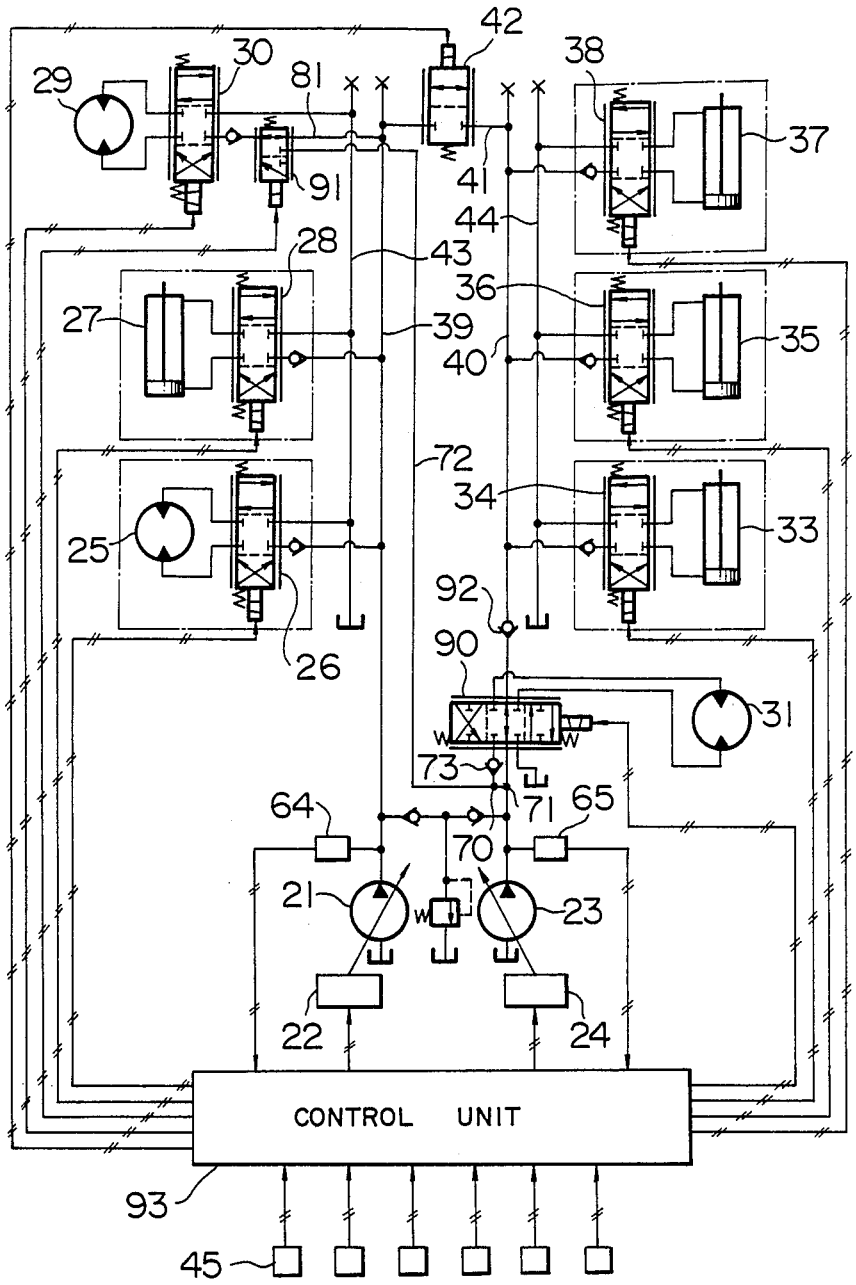
FIG. 13 is a circuit diagram showing a hydraulic drive system in a yet further embodiment according to the present invention.

In the embodiment shown in FIG. 13, in addition to the arrangement of the first through fourth communication lines 42, 72, 73 and 81 and the first on-off valve 42, a right travel directional control valve 90 is adapted to include a function of the second valve means or on-off valve 74 referred to in the embodiments shown in FIGS. 10 and 12. Also, a single valve means or control valve 91 is connected between the third and fourth communication lines 72 and 81 and the left travel directional control valve 30, serving as the fourth valve means or on-off valve 80 and the fifth valve means or on-off valve 82 in the embodiment shown in FIG. 12. A check valve for preventing reverse flow is situated downstream of the right travel valve 90.

In this embodiment shown in FIG. 13, by appropriately actuating the on-off valve 42, right travel valve 90 and control valve 91 by control signals provided by a control unit 93, it is possible, like the embodiment shown in FIG. 12, to ensure completely independent driving of the travel motors and carry out combined operation of travelling and other operations as well as single operation of travelling, thereby attaining the effect and advantage similar to those of the embodiments shown in FIGS. 10 and 12.

In this embodiment, further, there are provided the single control valve 91 instead of two on-off valves 80 and 82 in the embodiment shown in FIG. 12 and the right travel valve 90 including the function of the on-off valve 74 shown in FIGS. 10 and 12, and therefore the number of valves is less than the embodiments shown in FIGS. 10 and 12, thereby further reducing pressure loss in the circuits.

What is claimed is:

1. A hydraulic drive system for a construction machine comprising: hydraulic circuit means including at least one hydraulic pump, at least first and second hydraulic actuators driven by a hydraulic fluid discharged from said pump, and at least first and second directional control valves connected to said pump in parallel with each other for controlling flows of hydraulic fluid supplied from the pump to said first and second actuators, respectively; and control means responsive to first and second operation signals for driving said first and second actuators, respectively, to produce first and second control signals for actuating said first and second valves and deliver such control signals thereto, respectively, each of the first and second valves having a degree of opening changed in accordance with a level of the corresponding one of said first and second control signals for controlling a flow rate of hydraulic fluid supplied to the corresponding one of the first and second actuators:

said control means including restriction means for restricting the level of said first control signal delivered from the control means for restriction of the degree of opening of said first directional control valve when both of said first and second operation signals are entered in the control means for instruction to perform simultaneous driving of said first and second hydraulic actuators.

2. A hydraulic drive system as claimed in claim 1 in which said hydraulic circuit means includes a hydraulic actuator working at a large load and a hydraulic actuator working at a small load, wherein said first hydraulic actuator controlled by said first operation signal comprises said hydraulic actuator working at a small load, and said second hydraulic actuator controlled by said second operation signal comprises said hydraulic actuator working at a large load.

3. A hydraulic drive system as claimed in claim 1, wherein said restriction means includes a function means responsive to said second operation signal to produce a coefficient signal of a level which reduces as a level of the second operation signal increases, and multiplier means which receives said first operation signal and said coefficient signal for multiplication thereof, said first control signal being an output signal of said multiplier means.

4. A hydraulic drive system as claimed in claim 3 in which said hydraulic circuit means further includes a third hydraulic actuator driven by the hydraulic fluid discharged from said hydraulic pump, and a third directional control valve connected to the pump in parallel to at least said first directional control valve for controlling a flow of hydraulic fluid supplied from the pump to the third actuator, said control means further responsive to a third operation signal for driving the third actuator to produce a third control signal for actuating the third valve, wherein said restriction means further includes maximum value selection means for selecting one of said second and third operation signals which is larger in level than the other and delivering an output signal to said function means as said second operation signal.

5. A hydraulic drive system as claimed in claim 1 in which said construction machine includes at least a pair of travel devices and a boom, wherein said first hydraulic actuator controlled by said first operation signal comprises a pair of travel actuators connected to said pair of travel devices for operation thereof, respectively, and said second hydraulic actuator controlled by said second operation signal comprises at least one boom actuator connected to said boom for operation thereof, with said second operation signal being indicative of raising the boom.

6. A hydraulic drive system as claimed in claim 1 in which said construction machine includes at least a swing and an arm, wherein said first hydraulic actuator controlled by said first operation signal comprises an arm actuator connected to said arm for operation thereof, and said second hydraulic actuator controlled by said second operation signal comprises a swing actuator connected to said swing for operation thereof, with the first operation signal being indicative of lowering the arm.

7. A hydraulic drive system as claimed in claim 1 in which said construction machine includes at least a boom and a bucket, wherein said first hydraulic actuator controlled by said first operation signal comprises a bucket actuator connected to said bucket for operation thereof, and said second hydraulic actuator controlled by said second operation signal comprises a boom actuator connected to said boom for operation thereof, with the first operation signal being indicative of one of raising the bucket and lowering same.

8. A hydraulic drive system as claimed in claim 1 in which said construction machine includes at least a pair of travel devices, a swing, a boom and an arm; said hydraulic circuit means includes first and second hydraulic circuits having first and second hydraulic pumps, respectively, and includes a pair of travel hydraulic actuators, a swing hydraulic actuator, at least one boom hydraulic actuator and an arm hydraulic actuator driven by a hydraulic fluid discharged from at least one of said first and second pumps and connected to said pair of travel devices, swing, boom and arm for operation thereof, respectively, and first and second travel directional control valves, a swing directional control valve, a boom directional control valve and an arm directional control valve for controlling flows of hydraulic fluid supplied from at least one of said first and second pumps to said pair of travel actuators, swing actuator, boom actuator and arm actuator, respectively; and said control means is operative, in response to operation signals for driving the respective actuators, to produce control signals for actuating said valves and deliver such control signals thereto, wherein:

said first hydraulic circuit includes one of said pair of travel hydraulic actuators, said arm hydraulic actuator and said swing hydraulic actuator as well as said first travel directional control valve, said arm directional control valve and said swing directional control valve, the first travel, arm and swing valves being connected to said first hydraulic pump through a first hydraulic fluid supply line in parallel with each other;

said second hydraulic circuit includes the other of said pair of travel hydraulic actuator and said boom hydraulic actuator as well as said second travel directional control valve and said boom directional control valve, the second travel and boom valves being connected to said second hydraulic pump through a second hydraulic fluid supply line in parallel with each other;

said first hydraulic actuator and said first directinal control valve comprise at least one of said pair of travel actuators, swing actuator, boom actuator and arm actuator and at least one of said first and second travel valves, swing valve, boom valve and arm valve, respectively;

said second hydraulic actuator and said second directional control valve comprise at least one of said pair of travel actuators, swing actuator, boom actuator and arm actuator other than said first actuator comprises and at least one of said first and second travel valves, swing valve, boom valve and arm valve other than said first valve comprises, respectively;

said first and second supply lines are connected with each other through a first communication line at portions downstream of the respective associated valves, said first communication line having first valve means connected therein for interrupting communication through the first line; and said control means includes output means responsive to at least one operation singal for driving a predetermined one of said plurality of actuators to produce a control signal for actuating said first valve means and deliver such control signal to the first valve means.

9. A hydraulic drive system as claimed in claim 8, wherein said first hydraulic actuator and said first directional control valve comprise said pair of travel actuators and said first and second travel valves, respectively, and said second hydraulic actuator and said second directional control valve comprise said boom actuator and said boom valve, respectively.

10. A hydraulic drive system as claimed in claim 8, wherein said swing directional control valve is connected to said first hydraulic fluid supply line at a portion upstream of the other valves connected with the first supply line;

said first supply line includes second valve means connected therewith at a portion immediately downstream of said portion of the connection with said swing valve for interrupting communication through the first supply line; and said control means includes selection means responsive to operation signals for driving predetermined hydraulic actuators among said plurality of hydraulic actuators to select control signals for actuating said first and second valve means, said output means being adapted to deliver said control signals selected by the selection means.

11. A hydraulic drive system as claimed in claim 10, wherein said predetermined actuators comprise said swing actuator and boom actuator.

12. A hydraulic drive system as claimed in claim 10, wherein said predetermined actuators comprise said swing actuator and arm actuator.

13. A hydraulic drive system as claimed in claim 10, wherein said predetermined actuators comprise said swing actuator and one of said travel actuators.

14. A hydraulic drive system as claimed in claim 1 in which said construction machine includes at least a pair of travel devices, a swing, a boom and an arm; said hydraulic circuit means includes first and second hydraulic circuits having first and second hydraulic pumps, respectively, and includes a pair of travel hydraulic actuators, a swing hydraulic actuator, at least one boom hydraulic actuator and an arm hydraulic actuator driven by a hydraulic fluid discharged from at least one of said first and second pumps and connected to said pair of travel devices, swing, boom and arm for operation thereof, respectively, and first and second travel directional control valves, a swing directional control valve, a boom directional control valve and an arm directional control valve for controlling flows of hydraulic fluid supplied from at least one of said first and second pumps to said pair of travel actuators, swing actuator, boom actuator and arm actuator, respectively; and said control means is operative, in response to operation signals for driving the respective actuators, to produce control signals for actuating said valves and deliver such control signals thereto, wherein:

said first hydraulic circuit includes one of said pair of travel hydraulic actuators, said arm hydraulic actuator and said swing hydraulic actuator as well as said first travel directional control valve, said arm directional control valve and said swing directional control valve;

said second hydraulic circuit includes the other of said pair of travel hydraulic actuator and said boom hydraulic actuator as well as said second travel directional control valve and said boom directional control valve;

said first and second supply lines are connected with each other through a first communication line at portions downstream of the respective associated valves, said first communication line having first valve means connected therein for interrupting communication through the first line;

said first travel valve is connected to said second supply line through a second communication line at a portion downstream of a portion where said second travel valve is connected to said second supply line through a third communication line in parallel with said first travel valve, said second supply line having second valve means connected therein downstream of said connecting portions for interrupting communication through the second supply line;

said control means includes selection means responsive to operation signals for driving predetermined actuators among said plurality of actuators to select control signals for actuating said first and second valve means and deliver such control signals to the first and second valve means;

said first hydraulic actuator and said first directional control valve comprise at least one of said swing actuator, boom actuator and arm actuator and at least one of said swing valve, boom valve and arm valve, respectively; and said second hydraulic actuator and said second directional control valve comprise at least one of said swing actuator, boom actuator and arm actuator other than said first actuator comprises and at least one of said swing valve, boom valve and arm valve other than said first valve comprsies, respectively.

15. A hydraulic drive system as claimed in claim 14, wherein said second hydraulic fluid supply line includes third valve means connected therein between said portion of the connection with said second communication line and said portion of the connection with said third communication line for interrupting communication through the second supply line, and said selection means is further responsive to the operation signals for driving said predetermined actuators to select a control signal for actuating said third valve and deliver such control signal thereto.

16. A hydraulic drive system as claimed in claim 14, wherein said second communication line includes fourth valve means connected therein for interrupting communication through the second line, said first travel directional control valve is further connected to said first hydraulic fluid supply line through a fourth communication line in parallel with said arm and swing directional control valves, said fourth communication line includes fifth valve means connected therein for interrupting communication through the fourth line, and said selection means is further responsive to the operation signals for driving said predetermined actuators to select control signals for actuating said fourth and fifth valve means and deliver such control signals thereto.

17. A hydraulic drive system as claimed in claim 16, wherein said fourth and fifth valve means comprise a single valve means.

18. A hydraulic drive system as claimed in claim 14, wherein said second travel directional control valve includes said second valve means.

* * * * *